US005971337A

United States Patent [19]

Furuya

[11] Patent Number: 5,971,337

[45] Date of Patent: Oct. 26, 1999

[54] BOLT FALLING PREVENTION HOLDER

[75] Inventor: Yoshinobu Furuya, Shizuoka, Japan

[73] Assignee: Yazaki Corporation, Toyko, Japan

[21] Appl. No.: 08/943,187

[22] Filed: Oct. 3, 1997

[51] Int. Cl.[6] ..... A47F 5/00

[52] U.S. Cl. ..... 248/314; 248/309.1

[58] Field of Search ..... 248/314, 221.11, 248/222.11, 222.13, 56, 544, 547

[56] References Cited

U.S. PATENT DOCUMENTS

| | | | |
|---|---|---|---|
| 717,316 | 12/1902 | Avery | 248/239 X |
| 2,876,276 | 3/1959 | Melton | 174/35 |
| 3,096,960 | 7/1963 | Kinney | 248/113 |
| 3,113,358 | 12/1963 | Zell et al. | 20/92.4 |
| 3,219,812 | 11/1965 | Turner | 240/25 |
| 3,388,884 | 6/1968 | Eggler et al. | 248/224 |
| 4,208,702 | 6/1980 | Wotowiec | 362/217 |
| 4,795,121 | 1/1989 | Comito | 248/314 |
| 5,141,193 | 8/1992 | Behr | 249/309.1 |
| 5,267,710 | 12/1993 | Condon | 248/65 |

*Primary Examiner*—Leslie A. Braun
*Assistant Examiner*—Gwendolyn Baxter
*Attorney, Agent, or Firm*—Sughrue, Mion, Zinn, Macpeak & Seas, PLLC

[57] ABSTRACT

A bolt falling prevention holder which prevents the falling of a bolt when fastening and removing a part or a member, mounted within a case, using a fastening tool, thereby enhancing the efficiency of the operation and the safety. The bolt falling prevention holder includes a hollow holder portion, and a fixing portion for fixing the holder to the case in such a manner that the holder portion is maintained at a predetermined angle, the fixing portion having a retaining hole formed in one end thereof. A bolt insertion hole is formed through a predetermined portion of the case of an electric connection box, and a retaining member for engagement with the fixing portion is mounted on the case in the vicinity of the bolt insertion hole. A projection for retaining engagement in the retaining hole is formed on an outer surface of the retaining member. When the fixing portion is into engaged with the retaining member, the holder portion communicates with the bolt insertion hole, and a bolt, held by a torque wrench, can be guided through the holder portion into a bolt-tightening position in the case, and even if the bolt is disengaged from the torque wrench, the bolt can remain within the holder portion, thereby positively preventing the bolt from falling into the electric connection box.

5 Claims, 5 Drawing Sheets

BOLT FALLING PREVENTION HOLDER

BACKGROUND OF THE INVENTION

1. Field of the Invention

This invention relates to a bolt falling prevention structure for preventing the falling of a bolt during a bolt-tightening operation within an electric connection box (having various electric parts mounted therein) mounted on a vehicle such as an automobile.

2. Background

In current automobiles, various operations are effected automatically, and in this connection various kinds of electronic devices for controlling the travel of the automobile, as well as various kinds of electric parts including fuses and relays, are mounted within an electric connection box. The electric connection box contains wiring members including a fuse holder and connectors, and these wiring members are connected to the various electric parts through bus bars and connection wires.

As shown in FIGS. 6 and 7, a conventional electric connection box 31 includes bus bars (electrically-conductive members) 32, 33 and 34, and a bent portion 32*a* of the bus bar 32 overlaps the connecting bus bar 33 of an L-shape, and these bus bars 32 and 33 are fastened together by a bolt 35 and a nut 36. The connecting bus bar 33 also overlaps the external-connection bus bar 34, and these bus bars 33 and 34 are fastened together by a bolt 38 and a nut 37.

The bus bars 32 and 33, part of the external-connection bus bar 34 and a fuse holder (not shown) are covered by a cover 41. A bus bar-insulating grommet 42 is mounted on that portion (lead-out portion) of the external-connection bus bar 34 which extends through the cover 41.

For effecting the maintenance of this electric connection box 31, it is necessary to remove part of the bus bars 32, 33 and 34, and the bolts 35 and 38 must be removed and again tightened. Therefore, a bolt insertion hole 43 is formed through a portion of the case 41, and a fastening tool 44, such as a torque wrench, is inserted through the bolt insertion hole 43 so as to remove and tighten the bolt 35.

More specifically, for tightening the bolt 35, the bolt 35 is held by the fastening tool 44 as shown in phantom, and the bolt 35 is threaded into the nut 36. In contrast, for loosening and removing the tightened bolt 35, the fastening tool 44 is inserted through the bolt insertion hole 43, and is fitted on the bolt 35, and then is turned, and the bolt 35, disengaged from the nut 36, is held by the fastening tool 44, and is taken out of the cover 41.

Japanese Utility Model Unexamined Publication No. 6-59620 discloses a nut fixing structure for preventing the falling of a nut. As shown in FIG. 8, in this nut fixing structure, a bolt insertion hole 55 is formed through an attachment portion 58 such as an electric connection box, and a bolt insertion hole 53 is formed through a fixing portion 52 such as a fixing wall. A bolt 60 is inserted from the side of the attachment portion 58, and is threaded into a nut 54 provided at the fixing portion 52.

A nut rotation prevention rib 56 of a hexagonal shape for loosely receiving the nut 54 is formed on the fixing portion 52, and the nut 54 is received within this rib 56 in such a manner that the nut 54 is movable in an axial direction, but can not rotate in a circumferential direction.

Therefore, the nut 54 is received within the rib 56, and in this condition, when the bolt 60 is turned by a fastening tool, the threading operation can be effected without the need for fixing the nut 54 by any additional means. The rib 56 is formed into such a height that it extends beyond the distal end of the tightened bolt 60, and hence the distal end of the bolt 60 will not project outwardly from the rib 56.

A cover 50 for closing an open end of the rib 56 is mounted on the rib 56. The cover 50 is molded integrally with the rib 56 through a connecting portion 51, and the cover 50 closes the open end of the rib 56, with a retaining piece portion 57 retained on a retaining portion 59.

With this construction, a wire harness and other members, provided in the vicinity of the fixing portion, will not contact the distal end of the bolt 60, and therefore will not be damaged. The cover 50 has a nut support portion 62 which supports the nut 54 when the cover 50 is in its closed position. This nut support portion 62 is made of an elastic material, and has, for example, a hexagonal shape, and is fitted in the rib 56, the nut support portion 62 being hollow so that it will not contact the bolt 60. When the cover 50 is closed, the nut support portion 62 supports the nut 54, and urges the nut 54 against a bottom surface 56*a* of the rib 56 by its elastic force.

Therefore, the height of the nut support portion 62 from the cover 50 is larger than the distance H between the nut 54 and the distal end of the rib 56.

In the above nut fixing structure, if the bolt 60 and the nut 54 are insufficiently fastened together, the bolt 60 is raised in the axial direction as shown in phantom, and therefore the fastened condition can be confirmed with the eyes.

Therefore, the operator further tightens the bolt in an amount corresponding to the amount of rising of the bolt, so that the completely-fastened condition can be achieved.

When the bolt 60 is loosened, and is disengaged from the nut 54, the nut 54 is supported by the nut support portion 62, and therefore will not roll out of the rib 56, so that the bolt can again be tightened relative to the nut 54.

Japanese Utility Model Unexamined Publication No. 5-11723 discloses a bolt fixing clip for fixing a bolt. As shown in FIGS. 9 to 11, the clip 71, molded into an integral construction, includes a wire fixing portion 72, and a bolt retaining portion 73 connected to the wire fixing portion 72 by a connecting portion 81.

A cone-shaped claw portion 76 is provided within a cylindrical barrel portion 77, and is connected to an inner surface of this barrel portion 77. The claw portion 76 is divided by a plurality of grooves 83, and has two small piece portions 78 as shown in FIG. 11. In this claw portion 76, a distal end of its body and distal ends 82*b* of the small piece portions 78 jointly form one circumferential edge portion, and this portion is retainingly engaged with a bolt 74.

Each small piece portions 78 is in the form of a narrow rectangular plate, and is connected by a hinge portion 80 to the inner surface of the barrel portion 77 intermediate the opposite ends thereof, and is separated from the barrel portion 77 and the claw portion 76, and is gently curved or bent in the vicinity of the hinge portion 80. A flexure prevention rib 79 is formed on a rear surface of the small piece portion 78, and extends from the distal end 82*b* in the longitudinal direction, the flexure prevention rib 79 being spaced a predetermined distance from the barrel portion 77.

When the bolt retaining portion 73 of the clip 71 is pressed onto the bolt 74 mounted on a body 75, the distal end of the claw portion 76 is retained in a groove of a screw thread of the bolt 74, so that the clip 71 is fixed to the body 75. At this time, the distal end 82*b* of each of the small piece portions 78 is turned about the hinge portion 80, thereby ensuring the mounting of the clip 71 on the body 75.

In the above retained condition, when a load F is exerted on the retaining portion 73, the whole of the retaining portion 73 is tilted as shown in phantom, and the small piece portion 78 is pushed by the screw thread of the bolt 74, and tends to be turned about the hinge portion 80. However, since the rib 79 is formed on the rear surface of the small piece portion 78, the displacement of the small piece portion 78 is prevented, so that the distal end of the claw portion 76 is kept engaged with the screw thread of the bolt 74. Therefore, the claw portion 76 is prevented from being displaced relative to the bolt 74, and therefore the clip 71 will not be disengaged from the bolt 74, thereby preventing the disengagement of the bolt.

However, in the electric connection box 31 described above with reference to FIGS. 6 and 7, when tightening or removing the bolt 35 by the use of the fastening tool 44, the bolt 35 is merely fitted in the fastening tool 44, and therefore is liable to fall within the case 41. If the bolt 35, which has thus fallen, is left as it is, there is a possibility of an accident such as the short-circuiting of the bus bar 32 or the bus bar 34, and therefore there is encountered a problem that the bolt 35 must be picked up after the case 41 is removed, and then the case 41 must be again fixed.

In addition, if the bolt 35 falls during the removal of the bus bar 32, for example, for maintenance purposes after the electric connection box 31 is mounted on the vehicle, it is necessary to remove the electric connection box 31 from the vehicle, and then to remove the case 41 so as to pick up the bolt 35, and then to mount these parts in their respective original positions. Thus, there is encountered a problem that such a cumbersome operation is needed.

For tightening the bolt 35, the fastening operation can be effected while provisionally retaining the bolt 35 relative to the fastening tool 44 by a tape or the like. However, the provisional retaining of the bolt 35 by the tape or the like requires additional time and labor, and this worsens the efficiency of the operation, and besides when removing the bolt 35, the provisional retaining by the tape can not be used, and there is a high possibility that the bolt 35 falls off the fastening tool 44, and this method is not entirely effective in solving the above problem.

In the nut fixing structure described above with reference to FIG. 8, although the falling of the nut can be prevented, the holding of the bolt is not effected at all, and the problem described above for FIGS. 6 and 7 can not be solved.

In the bolt fixing clip described above with reference to FIGS. 9 to 11, although the disengagement of the bolt can be prevented, the falling of the bolt off the fastening tool can not be prevented when tightening and removing the bolt, and the problem described above for FIGS. 6 and 7 can not be solved.

SUMMARY OF THE INVENTION

It is an object of this invention to provide a bolt falling prevention structure which prevents the falling of a bolt when fastening and removing a part or a member (to which the hand is not accessible from the exterior), mounted within a case, using a fastening tool, thereby enhancing the efficiency of the operation and the safety.

The above object of the invention has been achieved by a bolt falling prevention holder described in the following paragraphs 1) to 3).

1) A bolt falling prevention holder for preventing the falling of a bolt during a fastening operation by the bolt within an electric connection box having various electric parts mounted therein, the bolt falling prevention holder including a hollow holder portion for guiding the bolt held by a fastening tool, and a plate-like fixing portion for maintaining the holder portion at a predetermined angle.

2) The bolt falling prevention holder, in which an opening is formed through a wall of a case covering the electric parts, and communicates with the holder portion, and a retaining member for receiving the fixing portion is mounted on that portion of an inner surface of the case disposed near to the opening.

3) The bolt falling prevention holder, in which a projection for retaining the fixing portion is formed on an outer surface of the retaining member, and a retaining hole for retaining the projection is formed in the fixing portion.

The bolt falling prevention holder of the invention, described in the above paragraphs 1) to 3), includes the holder portion for guiding the bolt held by the fastening tool, and the plate-like fixing portion for maintaining the holder portion at the predetermined angle, the fixing portion having the retaining hole. The opening, which communicates with the holder portion mounted on the case covering the electric parts, is formed, and the retaining member is mounted on that portion of the inner surface of the case disposed near to the opening, and the projection for retaining the fixing portion is formed on the outer surface of the retaining member.

Therefore, when the fixing portion of the bolt falling prevention structure is inserted into a space between the retaining member and the inner surface of the case, the retaining hole formed in the fixing portion is retained on the projection formed on the outer surface of the retaining member, thereby fixing the bolt falling prevention holder relative to the opening in the case. At this time, the holder portion of the bolt falling prevention holder communicates with the opening in the case.

The fastening tool, holding the bolt at its distal end, is inserted into the holder portion, and is guided into the predetermined position, and the bolt can be easily tightened by this fastening tool. At this time, even if the bolt is disengaged from the fastening tool, the bolt remains within the holder portion, thereby positively preventing the bolt from falling into the electric connection box.

For loosening and removing the bolt, the fastening tool, while guided by the holder portion, is inserted, and the bolt can be easily disengaged from the nut, and the disengaged bolt is positively prevented from falling into the electric connection box.

DETAILED DESCRIPTION OF THE PREFERRED EMBODIMENT

Figure 1:
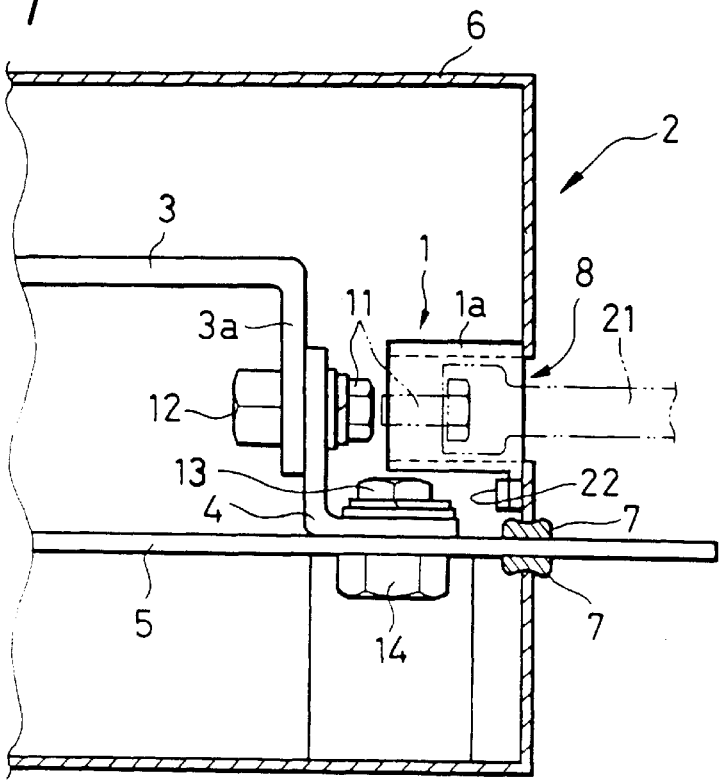
FIG. 1 is a cross-sectional view of an important portion of an electric connection box having one preferred embodiment of a bolt falling prevention structure of the invention.
Figure 2:
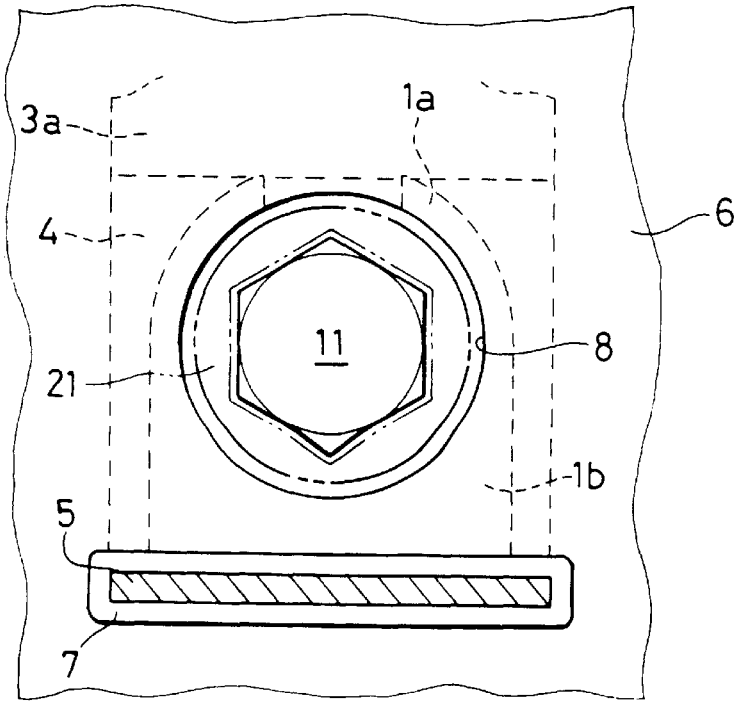
FIG. 2 is a side-elevational view of an important portion of the electric connection box of FIG. 1.
Figure 3:
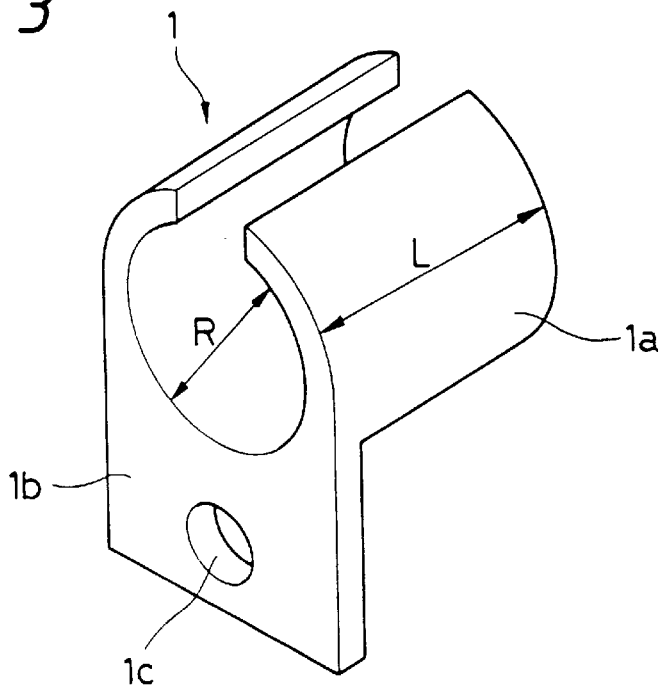
FIG. 3 is a perspective view showing the construction of the bolt falling prevention structure of FIG. 1.
Figure 4:
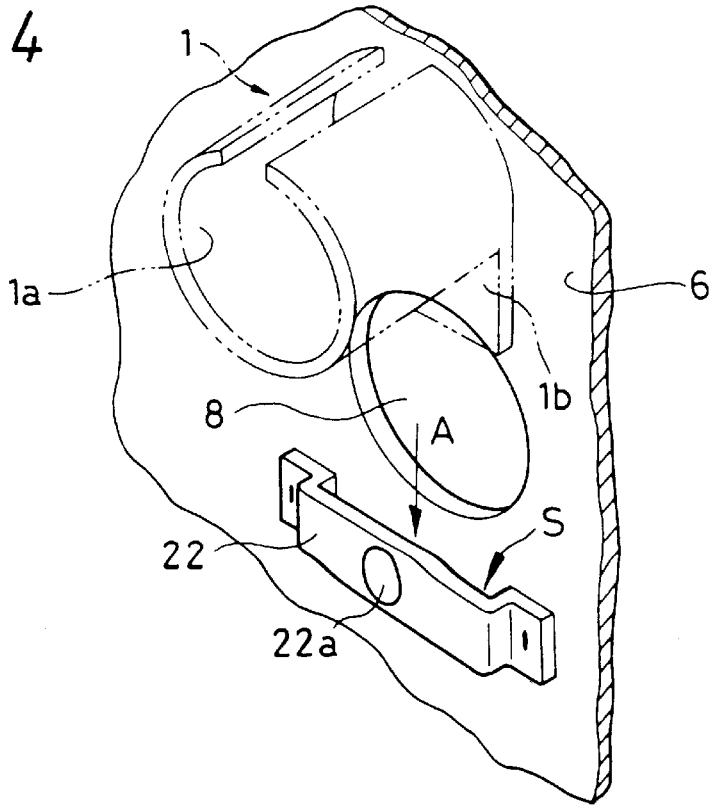
FIG. 4 is a perspective view of an important portion, showing a structure of fixing the bolt falling prevention structure of FIG. 1.
Figure 5:
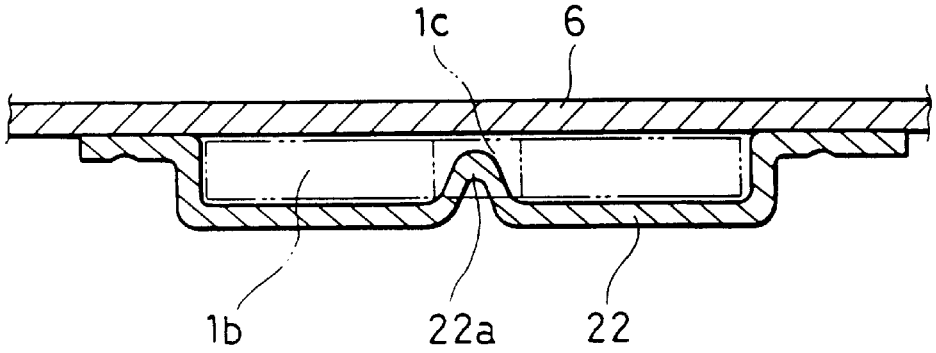
FIG. 5 is a cross-sectional view of the structure of FIG. 4.
Figure 6:
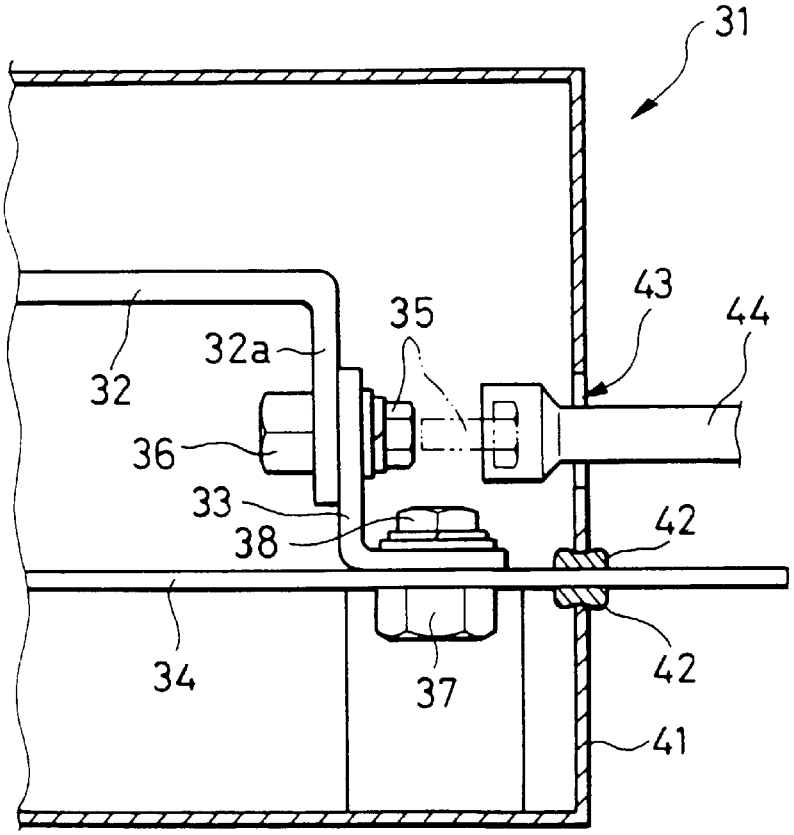
FIG. 6 PRIOR ART
FIG. 6 is a cross-sectional view of an important portion of a conventional electric connection box.
Figure 7:
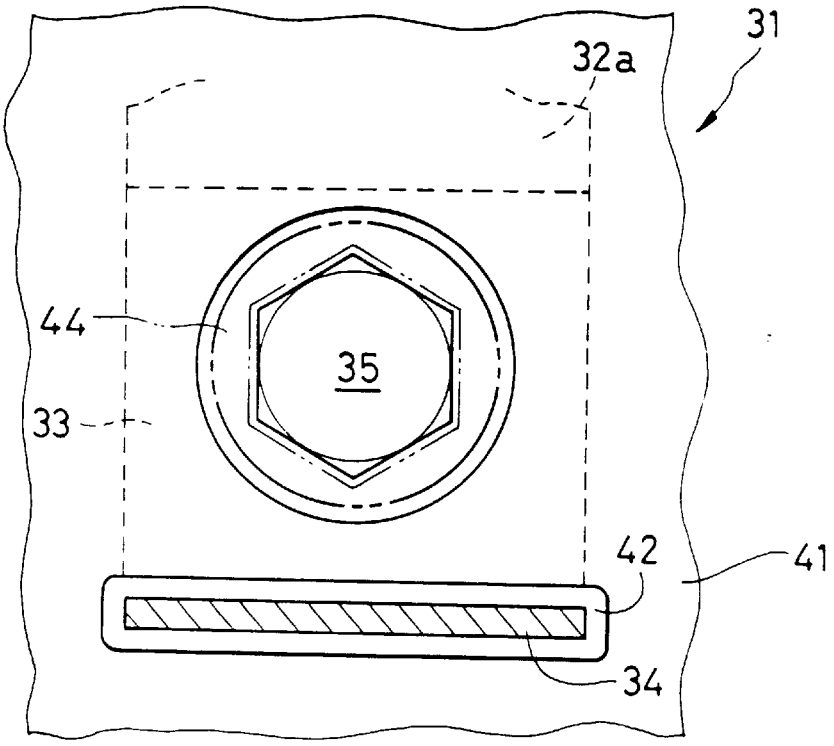
FIG. 7 PRIOR ART
FIG. 7 is a side-elevational view of an important portion of the electrical connection box of FIG. 6.
Figure 8:
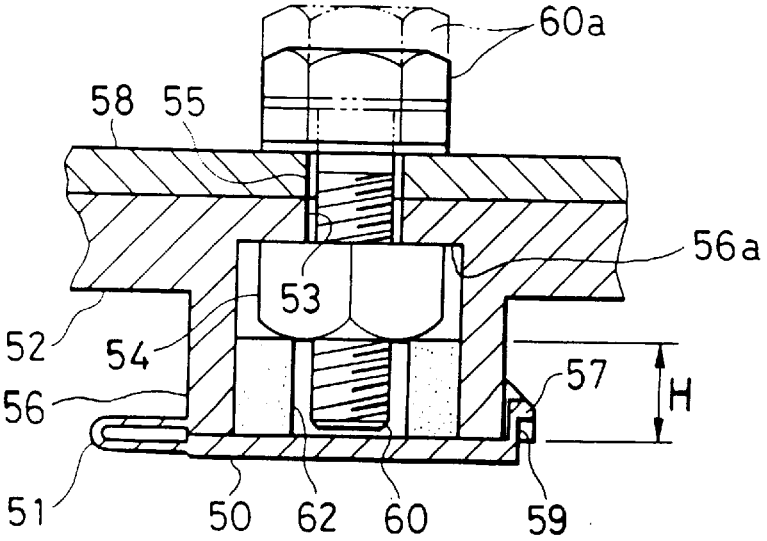
FIG. 8 PRIOR ART
FIG. 8 is cross-sectional view showing a conventional nut mixing structure.
Figure 9:
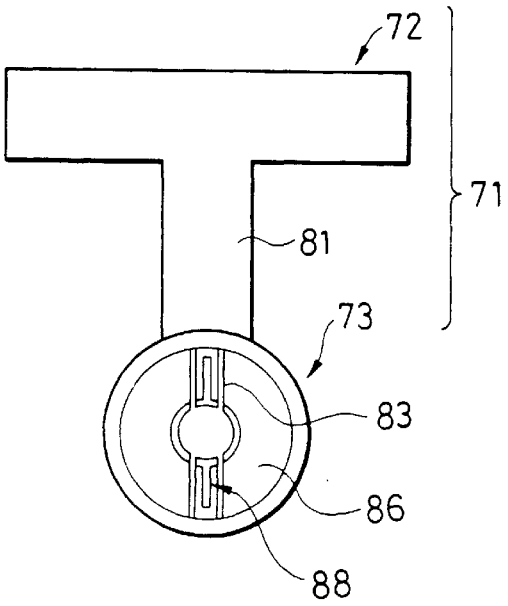
FIG. 9 PRIOR ART
FIG. 9 a is front-elevational view showing the construction of a conventional bolt fixing clip.
Figure 10:
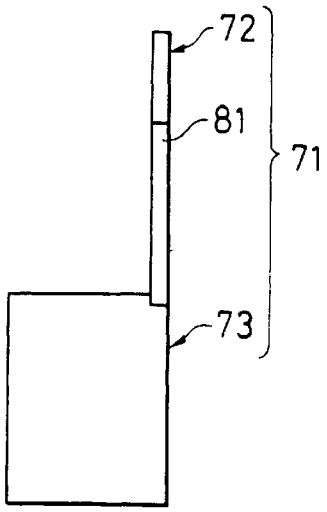
FIG. 10 PRIOR ART
FIG. 10 is a side-elevational view of the clip of FIG. 9.
Figure 11:
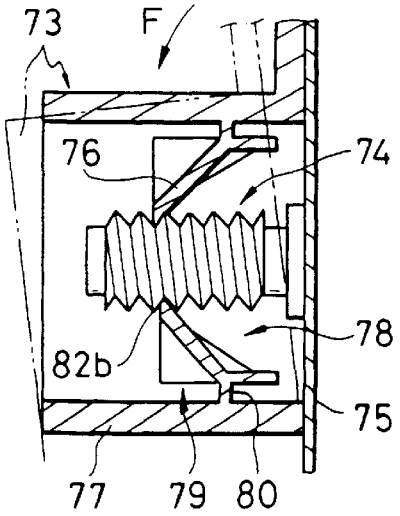
FIG. 11 PRIOR ART
FIG. 11 is a cross-sectional view showing an important portion of the clip of FIG. 10.

A preferred embodiment of a bolt falling prevention structure of the present invention will now be described in detail with reference to FIGS. 1 to 5. FIG. 1 is a cross-sectional view of an important portion of an electric connection box having a bolt falling prevention structure of the invention, showing an internal structure of the electric connection box. FIG. 2 is an enlarged, side-elevational view of an important portion, showing the construction of a bolt insertion portion in FIG. 1. FIG. 3 is a perspective view showing the construction of the bolt falling prevention structure of FIG. 1. FIG. 4 is a perspective view of an important portion, showing a structure of fixing the bolt falling prevention structure of FIG. 1, and FIG. 5 is a cross-sectional view of the structure of FIG. 4. With respect to the description of the preferred embodiment, the important portion of the electric connection box, having the bolt falling prevention structure, will be first described, and then the bolt falling prevention holder, the structure of fixing this holder, and so on will be described.

The bolt falling prevention holder 1 of this embodiment is used in the electric connection box 2 mounted on an automobile. Various electric parts, including fuses and relays, and connection parts, such as connectors, are mounted within the electric connection box 2, and the connection between the electric parts and the connection of the electric part to external electric equipment are made by strip-like bus bars 3, 4 and 5 made of an electrically-conductive material.

In the construction of the electric connection box 2 shown in FIGS. 1 and 2, one end of the bus bar 3 is connected to the electric part mounted within the electric connection box 2, and the other end thereof is connected via the connecting bus bar 4 to the bus bar 5 for external connection purposes. The external-connection bus bar 5 electrically connects the electric part within the electric connection box 2 to the electric equipment provided exteriorly of the electric connection box.

With respect to the arrangement of the bus bars 3, 4 and 5, one end portion of the bus bar 3 is bent into an L-shape. This bent portion 3*a* overlaps one end portion of the L-shaped bus bar 4, and these overlapped portions are fastened together by a bolt 11 and a nut 12. The other end portion of the bus bar 4 overlaps the bus bar 5, and these overlapped portions are fastened together by a bolt 13 and a nut 14. A flat washer and a spring washer are interposed between the bus bar 4 and each of the bolts 11 and 13. This construction is well known, and therefore are merely shown in the drawings.

The bus bars 3 and 4 and part of the bus bar 5 are covered with a case 6 formed of an iron plate or a synthetic resin material, and a bus bar-insulating grommet 7 is mounted on that portion (lead-out portion) of the bus bar 5 which extends through the case 6.

A bolt insertion hole (opening) 8 is formed through that portion of the case 6 disposed in registry with the bolt 11, and this bolt insertion hole 8 is used when inserting and removing the bolt 11 and when effecting the fastening operation. The bolt falling prevention structure 1 is mounted on the inner side of the case 6 in communication with the bolt insertion hole 8.

As shown in FIG. 3, the bolt falling prevention structure 1 of this embodiment has a holder portion 1*a* of a cylindrical shape, and a plate-like fixing portion 1*b* formed integrally with the holder portion 1*a*, the fixing portion 1*b* being retained on the case 6. The fixing portion 1*b* has a retaining hole 1*c* which is engaged with a projection 22*a* on a retaining member 22 described later.

An inner diameter R of the holder portion la is so determined that a torque wrench (fastening tool) 21 for fastening or tightening the bolt 11 can smoothly pass through the bore of the holder portion 1*a*. An overall length L of the bolt falling prevention structure 1 is so determined that when this structure 1 is fixed to the inner side of the case 6 as shown in FIG. 1, the holder 1 is spaced a suitable distance from the tightened bolt 11.

As shown in FIG. 4, the retaining member 22 for retaining the bolt falling prevention structure 1 is formed on that portion of the inner side of the case 6 disposed below the bolt insertion hole 8. This retaining member 22 includes a generally channel-shaped member, and is fixed at its opposite ends to the inner side of the case 6 by welding or the like. Therefore, a space S is formed between the retaining member 22 and the inner side of the case 6. This space S has such a size that the fixing portion 1*b* can be snugly fitted into the space S without shaking.

As shown in FIG. 5, the projection 22*a* for engagement in the retaining hole 1*c* is formed on a generally central portion of the retaining member 22.

For retaining the bolt falling prevention structure 1 on the retaining member 22, the fixing portion 1*b* of the bolt falling prevention holder 1 is inserted into the space S in a direction of arrow A (FIG. 4), so that the projection 22*a* is engaged in the retaining hole 1*c*, formed through the fixing portion 1*b*, with a click, as shown in FIG. 5. Therefore, the fixing of the bolt falling prevention structure 1 to the case 6 can be effected easily, and after this fixing operation, the movement of the bolt falling prevention structure 1 is limited since the space S corresponds in size to the fixing portion 1*b*, and also the projection 22*a* is engaged in the retaining hole 1*c*.

After the bolt falling prevention holder 1 is thus fixed to the inner side of the case 6, the torque wrench 21, holding the bolt 11 at its distal end as shown in phantom in FIG. 1, is inserted into the holder portion 1*a* of the bolt falling prevention structure 1, and the bolt 11 is threaded into the nut 12. At this time, the holder portion 1*a* guides the torque wrench 21, and therefore the bolt 11 can be easily aligned with the nut 12, thereby enhancing the efficiency of the fastening operation.

Even if the bolt 11 is disengaged from the torque wrench 21, the bolt 11 merely falls within the bolt falling prevention structure 1, that is, the holder portion 1*a*, and therefore the short-circuiting of the bus bars is positively prevented, thus providing the enhanced safety. Therefore, any cumbersome operation, such as the provisional retaining of the bolt 11 on the torque wrench 21 by a tape or the like, is not required at all.

Naturally, the maintenance of the electric connection box 2, mounted on the automobile or the like, must be taken into consideration. Namely, when it becomes necessary to remove the bolt 11 for effecting the maintenance of the electric connection box 2 having the bolt falling prevention structure 1, the bolt 11 is loosened, and at this time even if the bolt 11 falls, the bolt 11 is positively retained within the holder portion 1*a*. Therefore, any cumbersome operation, such as the removal of the case 6 for the purpose of picking up the bolt 11 which has fallen in the case 6 as in the conventional electric connection box, is not necessary, and therefore the safety and the operation efficiency during the maintenance are greatly enhanced.

As described above, the bolt falling prevention structure of the invention includes the hollow holder portion for guiding the bolt held by the fastening tool, and the plate-like fixing portion for maintaining this holder portion at the predetermined angle.

Therefore, when tightening the bolt by the fastening tool, the fastening tool, holding the bolt at its distal end, is inserted through the opening and the hollow holder portion, thereby guiding the bolt into the predetermined fastening position. And besides, even if the bolt is disengaged from the fastening tool, the bolt remains within the holder portion, thereby positively preventing the bolt from falling into the electric connection box. Therefore, the operation efficiency of the bolt falling prevention holder and the safety can both be enhanced. For For loosening and removing the bolt, the fastening tool is guided, and the disengaged bolt is prevented from falling into the electric connection box, and therefore the operation efficiency and the safety during the maintenance can be enhanced.

In the bolt falling prevention structure, the opening is formed through the wall of the case covering the electric parts, and communicates with the holder portion, and the retaining member for receiving the fixing portion is mounted on that portion of the inner surface of the case disposed near to this opening.

In the bolt falling prevention structure, the projection for retaining the fixing portion is formed on the outer surface of the retaining member, and the retaining hole for retaining the projection is formed in the fixing portion.

Therefore, when the fixing portion of the bolt falling prevention structure is inserted into the space between the retaining member and the inner surface of the case, the retaining hole formed in the fixing portion is retained on the projection formed on the outer surface of the retaining member, so that the structure portion of the bolt falling prevention holder can positively be aligned with and communicate with the opening in the case. Therefore, the operation efficiency of the bolt falling prevention structure and the safety can be further enhanced.

What is claimed is:

1. A bolt guiding and retaining arrangement comprising:

a casing including first and second members therein which are fastened together by a bolt when in a fastening position, a threaded portion of said bolt extending forwardly;

a bolt retaining member including a bolt guiding portion and a fixing portion secured to said casing, wherein said bolt guiding portion is aligned with said bolt and disposed rearward of said bolt when said bolt is in the fastening position such that said bolt is received in said bolt guiding portion during unfastening of said bolt.

2. The bolt guiding and retaining arrangement according to claim 1, wherein said bolt guiding portion is a hollow tube.

3. The bolt guiding and retaining structure arrangement according to claim 1, wherein said casing has an opening in a wall thereof which communicates with the bolt guiding portion wherein said arrangement further comprises:

a retaining member for receiving the fixing portion, the retaining member being formed on an inner surface of the casing disposed near the opening.

4. The bolt guiding and retaining arrangement according to claim 3, further comprising:

a projection for retaining the fixing portion, the projection being formed on a surface of the retaining member; said fixing portion having a retaining hole for retaining the projection, said retaining hole being formed in the fixing portion.

5. A bolt guiding structure comprising:

a casing including a first member and a second member;

a bolt receiving portion for guiding a bolt in the casing;

the bolt receiving portion having an opening for receiving the bolt as it is inserted into the first member and the second member; and a fixing portion extending from the bolt receiving portion for connecting the bolt receiving portion to the casing, wherein the bolt receiving portion has an arcuate cross-section.

* * * * *